US007894763B2

(12) United States Patent
Itoh et al.

(10) Patent No.: US 7,894,763 B2
(45) Date of Patent: Feb. 22, 2011

(54) IMAGE FORMING APPARATUS

(75) Inventors: Keiji Itoh, Saitama (JP); Masanori Nagashima, Saitama (JP); Yoshihiro Saitoh, Saitama (JP); Hiroaki Mogi, Saitama (JP); Toshiyuki Kitamura, Saitama (JP); Toshikatsu Takahashi, Saitama (JP); Takeshi Tsuge, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 357 days.

(21) Appl. No.: 11/398,625

(22) Filed: Apr. 6, 2006

(65) Prior Publication Data

US 2007/0063086 A1 Mar. 22, 2007

(30) Foreign Application Priority Data

Sep. 20, 2005 (JP) ..... P2005-272954

(51) Int. Cl.
*G03G 15/00* (2006.01)
*B65H 19/10* (2006.01)

(52) U.S. Cl. ..... 399/384; 400/692; 400/613; 242/348.4

(58) Field of Classification Search ..... 399/384; 226/89, 90
See application file for complete search history.

(56) References Cited

U.S. PATENT DOCUMENTS 6,661,984 B2 * 12/2003 Kojima ..... 399/110
7,203,448 B2 * 4/2007 Yokoi ..... 399/124
2002/0130215 A1 * 9/2002 Krivulin ..... 242/560.3

FOREIGN PATENT DOCUMENTS

| | | | | |
|---|---|---|---|---|
| JP | 48-074049 | U | | 9/1973 |
| JP | 61-069079 | A | | 4/1986 |
| JP | 05097299 | A | * | 4/1993 |
| JP | 07-300261 | A | | 11/1995 |
| JP | 2000-289896 | A | | 10/2000 |
| JP | 2003091748 | A | * | 3/2003 |

OTHER PUBLICATIONS

Japanese Office Action dated Feb. 9, 2010 in Japanese Application No. 2005-272954.

* cited by examiner

*Primary Examiner*—Daniel J Colilla
*Assistant Examiner*—Allister Primo
(74) *Attorney, Agent, or Firm*—Sughrue Mion, PLLC

(57) ABSTRACT

An image forming apparatus includes at least one paper supply portion including a roll paper accommodating portion adapted to accommodate a paper roll constituted by winding long paper around a shaft, a roll paper holding portion on which the paper roll is temporarily put, a paper feeding portion adapted to deliver paper from the paper roll accommodated on the roll paper accommodating portion, a horizontal rotating-shaft adapted to support the paper supply portion in a body of the image forming apparatus, the paper supply portion drawn outwardly from the body of the image forming apparatus by being rotated when change of the paper roll is performed, wherein the change of the paper roll can be performed by rotating the paper supply portion to thereby draw out the paper supply portion.

16 Claims, 5 Drawing Sheets

IMAGE FORMING APPARATUS

BACKGROUND OF THE INVENTION

1. Field of the invention

The present invention relates to an image forming apparatus enabled to reduce a burden due to change of roll paper.

2. Related art

Hitherto, image forming apparatuses, such as large-size drawing copiers and printers, use roll paper by mounting a shaft in the core of a paper roll around which long paper serving as a recording medium is wound. In a case where this roll paper is A0-size paper or A1-size paper wound therearound, an operation of changing roll paper is uneasy to perform, and involves risk, because the wide width and the large weight of roll paper. JP-A-2000-289896 has proposed a paper supply apparatus that has a roll paper holding member which is provided at an upper part of a casing of the paper supply apparatus and which permits roll paper to tentatively be put thereon, that mounts a shaft therein after a paper roll is once put on the holding member, and that subsequently lowers the paper roll to a roll paper accommodating portion which then accommodates the roll paper.

The related roll feeding apparatus is adapted to put a paper roll once on the roll paper holding member to thereby reduce the risk of accommodating the roll paper in the roll paper accommodating portion in an unstable state at the change of the roll paper. However, the roll paper may drop in the operation of accommodating roll paper in the roll paper accommodating portion due to the difference in height between the roll paper holding portion and the roll paper accommodating portion.

SUMMARY OF THE INVENTION

The present invention has been made in view of the above circumstances and provides an image forming apparatus enabled to reduce the burden and risk due to the change of roll paper.

According to the invention, there is provided an image forming apparatus that comprises at least one paper supply portion, which has a roll paper accommodating portion adapted to accommodate a paper roll constituted by winding long paper around a shaft, a roll paper holding portion on which the paper roll is temporarily put, and a paper feeding portion adapted to deliver paper from the paper roll accommodated on the roll paper accommodating portion, and that also comprises a horizontal rotating-shaft adapted to support the paper supply portion in a body of the image forming apparatus so that the paper supply portion can be drawn outwardly from the body of the image forming apparatus by being rotated when change of the paper roll is performed. In this image forming apparatus, the change of the paper roll can be performed by rotating the paper supply portion to thereby draw out the paper supply portion.

Further, the roll paper accommodating portion may comprise holding section adapted to hold the shaft to be rotatable when operated, guiding section adapted to be arranged together with the roll paper holding portion in a substantially horizontal line when the paper supply portion is rotated and is drawn out, thereby to lead the paper roll to the roll paper accommodating portion, and suppressing section adapted to suppress the paper roll from spontaneously performing rotational displacement when the paper supply portion is rotated and is drawn out.

Furthermore, the paper feeding portion may be placed in the vicinity of an upper part of the paper supply portion when the paper supply portion is rotated and is drawn out. Also, the roll paper holding portion may have a handle part used to rotate and draw out the paper supply portion.

Also, the image forming apparatus according to the invention may have a plurality of the paper supply portions.

BRIEF DESCRIPTION OF THE DRAWINGS

Preferred embodiment(s) of the present invention will be described in detail based on the following figure wherein.

DETAILED DESCRIPTION OF THE INVENTION

Figure 1:
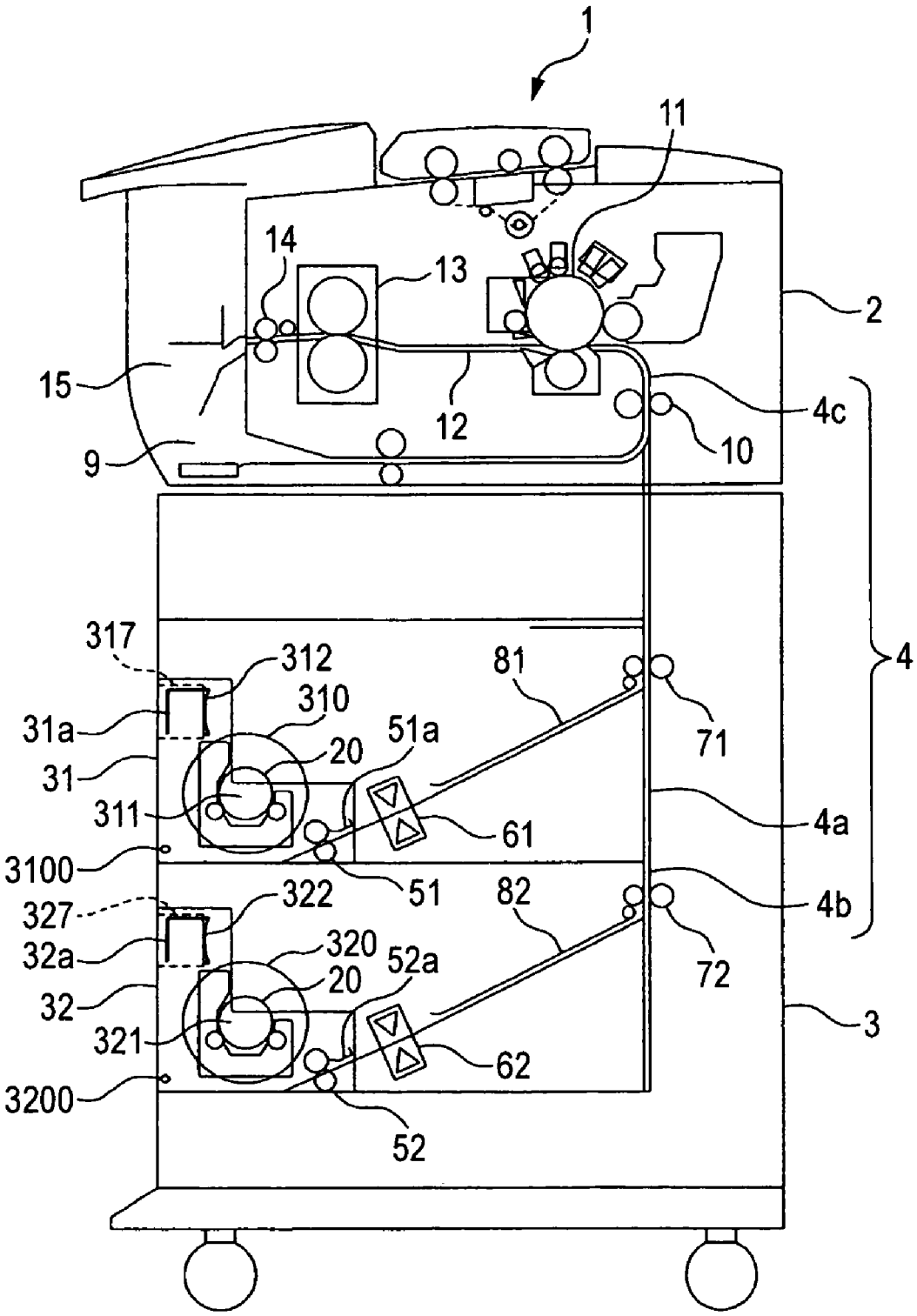
FIG. 1 is a cross-sectional view illustrating an image forming apparatus according to an embodiment of the invention.

An embodiment of the invention is described hereinbelow by referring to the accompanying drawings. FIG. 1 is a cross-sectional view illustrating an image forming apparatus according to an embodiment of the invention. The image forming apparatus shown in FIG. 1 includes an image forming portion 2 adapted to form an image on paper, and also includes a paper supply unit 3 adapted to provide paper to the image forming portion 2. The paper supply unit 3 has casings 31 and 32 in each of which paper rolls 310 and 320 are accommodated in roll paper accommodating portions 311 and 321, respectively. Incidentally, each of the roll paper accommodating portions 311 and 321 supports both ends of a corresponding one of the paper rolls 310 and 320 to thereby accommodate the corresponding one of the paper rolls 310 and 320. Additionally, the paper supply unit 3 may include a plurality of the casings, for example, the casings 31 and 32.

Also, drawing levers 31a and 32a are provided in leftwardly upper concave portions 317 and 327 of the casings 31 and 32 shown in FIG. 1, respectively. The paper rolls accommodated in the casings can be replaced by using these drawing levers 31*a* and 32*a* as handles to thereby draw out the casings 31 and 32.

Figure 2:
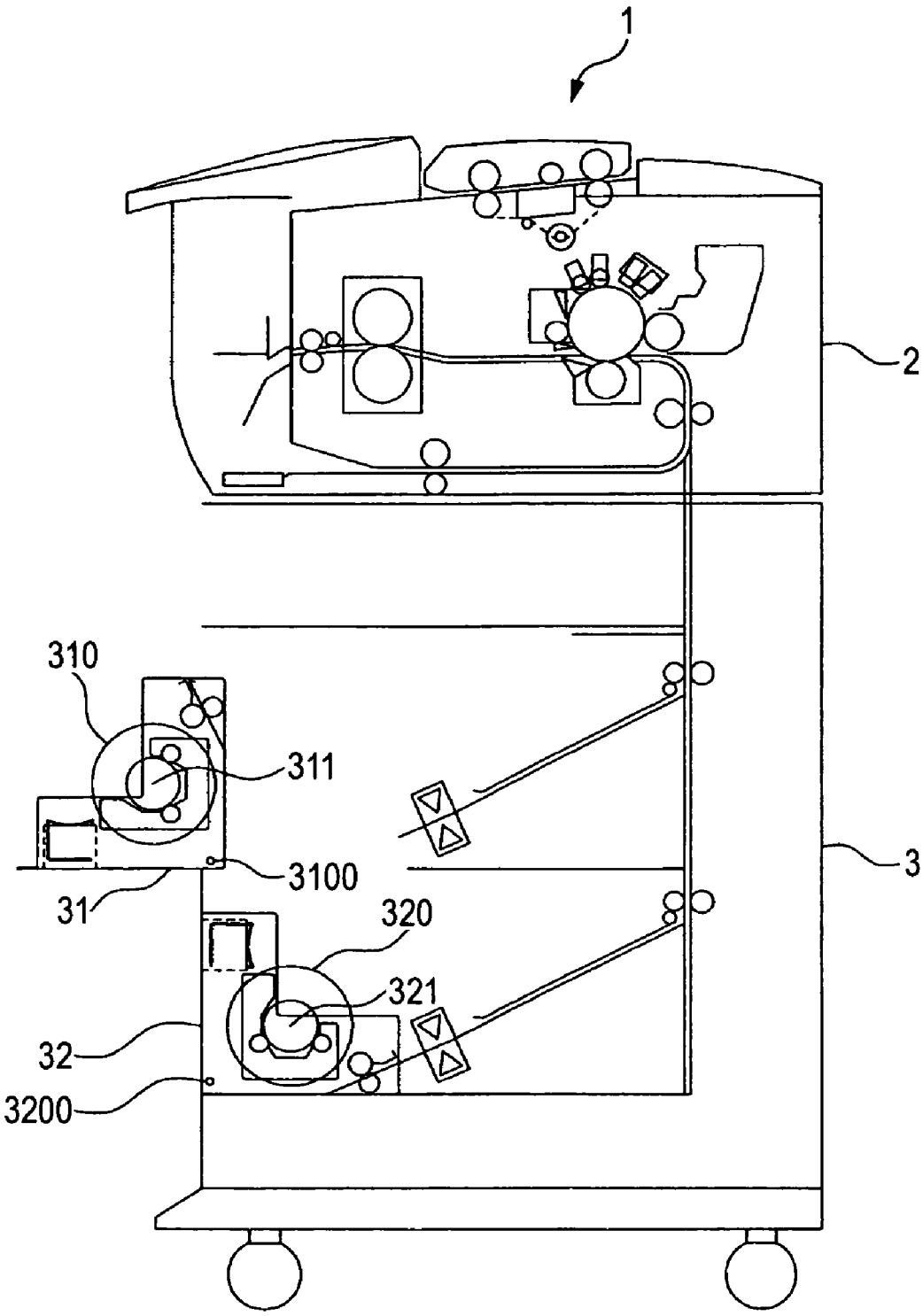
FIG. 2 is a cross-sectional view illustrating a state in which a casing of a paper supply unit of the image forming apparatus shown in FIG. 1 is drawn out.

FIG. 2 is a cross-sectional view illustrating a state in which a casing of a paper supply unit of the image forming apparatus shown in FIG. 1 is drawn out. The casing 31 shown in FIG. 2 includes the roll paper accommodating portion 311 that accommodates the paper roll 310 around which long paper is wound. The size or width of the paper roll 310 ranges up to 36 inches (91.44 mm). Also, as shown in FIG. 1, a horizontal rotating shaft 3100 is provided in the vicinity of a lower part of a left side surface of the casing 31. The casing 31 is supported by the horizontal rotating shaft 3100 on the paper supply unit 3. As shown in FIG. 2, the casing 31 is configured to be drawn outwardly (that is, leftwardly in this figure) by being rotated around the horizontal rotating shaft serving as an axis of rotation substantially 90 degrees. Also, the casing 32 is configured similarly to the casing 31 to have the roll paper accommodating portion 321 that accommodates the paper roll 320. A user can draw the casing 32 out of the body of the image forming apparatus 1 by rotating the casing 32 around the horizontal rotating shaft 3200 serving as an axis of rotation substantially 90 degrees. FIG. 2 shows an operating state in which the paper roll 320 is accommodated in the roll paper accommodating portion 321, without drawing out the casing 32 by rotating the casing 32 substantially 90 degrees.

As shown in FIG. 1, each of the casings 31 and 32 has a feeding path 4 used to feed paper, which is drawn out of a corresponding one of the paper rolls 310 and 320, from the paper supply unit 3 to the image forming portion 2. Incidentally, the feeding path 4 is divided into a part 4*a* provided in the casing 31, a part 4*b* provided in the casing 32, and a part 4*c* provided in the image forming portion 2. Also, as shown in FIG. 1, the casing 31 (32) has delivery rollers 51 (52), a feeding path 51*a* (52*a*), a cutter 61 (62), a feeding roller 71 (72), and an auxiliary feeding path 81 (82). The roll paper 310 (320) is feeded from the delivery roller 51 (52) through the feeding path 51*a* (52*a*) and the auxiliary feeding path 81 (82). The cutter 61 (62) is provided on the auxiliary feeding path 81 (82), and cuts the roll paper 310 (320). The cut paper is sent to the feeding path 4 by the feeding roller 71 (72).

In a case where image formation processing is performed on paper drawn out of the paper roll 310, the paper supplied to the part 4*a* of the feeding path 4 is supplied to the part 4*c* of the feeding path 4 by the feeding roller 71. The paper supplied to the part 4*c* of the feeding path 4 is further feeded to a photoreceptor drum 11 by the feeding roller 10. The photoreceptor drum 11 transfers a toner image, which is formed thereon, onto the paper. The paper, onto which the toner image is transferred, is led to a fixing portion 13 that performs the fixation of the image. Upon completion of fixation of the image onto the paper, the paper is feeded to a discharging roller 14 and is subsequently discharged from a paper discharging port 15. Incidentally, a manual paper feeding portion 9 is provided on a left side surface of the image forming portion 2 shown in FIG. 1. A standard-size cut-sheet can be supplied to the part 4*c* of the feeding path 43 by being manually supplied from the portion 9.

The casing 31 (32) shown in FIG. 1 is further provided with a concave roll paper holding portion 312 (322), on which the paper roll 310 (320) can temporarily be put, in a state in which the casing 31 (32) is drawn outwardly (leftwardly as viewed in FIG. 1) by being rotated substantially 90 degrees with respect to the image forming apparatus 1. Hereinafter, the roll paper holding portion 312 and 322, the roll paper accommodating portion 311 and 321, and the like are described with reference to FIGS. 3 and 4.

Figure 3:
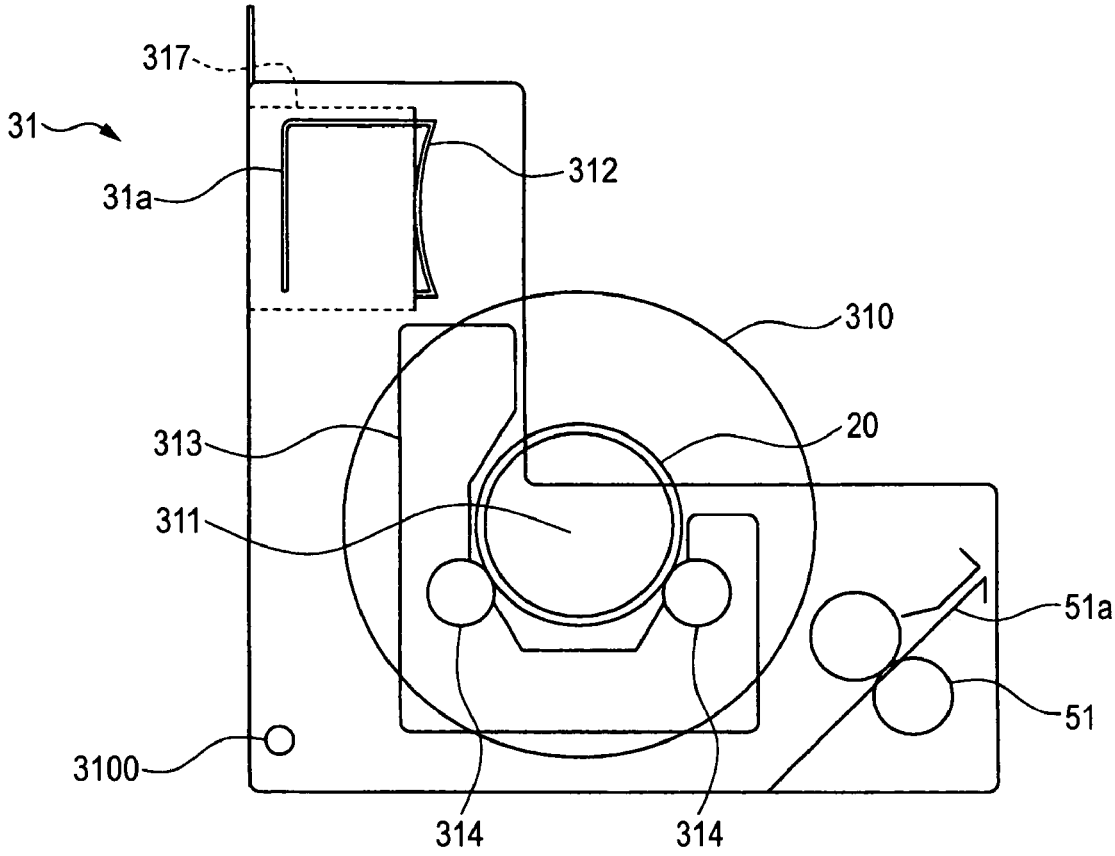
FIG. 3 is an enlarged cross-sectional view illustrating a state of the paper supply unit in an ordinary operation.

FIG. 3 is a view illustrating the casing 31 in a state where the paper roll 310, in which a cylindrical shaft 20 is mounted, is accommodated in the roll paper accommodating portion 311. The roll paper accommodating portion 311 includes a pair of shaft holding members 313 respectively provided at both ends of the casing 31. The roll paper 310 is accommodated in the roll paper accommodating portion 311 in a state in which both ends of the shaft 20 are engaged on the pair of shaft holding members 313, respectively. Also, two rotating balls 312 are rotatably fitted in a tangential surface of each of the shaft holding members 313 with respect to the shaft 20. The shaft 20 is rotatably supported on the two rotating balls 314 serving as supporting-points. Thus, the roll paper accommodating portion 311 can accommodate the roll paper 310 that is rotatable around the shaft 20. Additionally, the rotating ball 314 may be modified by being shaped like a roller, such as a bearing, instead of a sphere.

As viewed in FIG. 3, the concave portion 317 is provided in an upper part of the left side surface of the casing 31. The roll paper holding portion 312 is provided on the right side surface of the concave portion 317. The roll paper holding portion 312 is manufactured by, for example, machining a sheet of metal and subsequently deforming the sheet of metal. Incidentally, the roll paper holding portion 312 may have a drawing lever 31*a*. That is, a handle may be formed by causing a part of the roll paper holding portion 312 to penetrate a through hole formed in an upper part of the right side surface of the concave portion 317 to the outside and subsequently and downwardly bending the part of the roll paper holding portion 312 substantially 90 degrees. Also, the handle may be used as the drawing lever 31*a*. In this case, the necessity for providing the roll paper holding portion 312 and the drawing lever 31 separately from each other is eliminated. Thus, an advantage in reducing the cost of the apparatus can be obtained.

Additionally, the delivery rollers 51 and the feeding path 51*a* are provided at a rightwardly lower portion of the casing 31, as viewed in this figure, and deliver paper drawn out of the paper roll to the feeding path 4 through the auxiliary feeding path 81. The horizontal rotating shaft 3100 is provided at a leftwardly upper portion of the casing 31, so that the casing 31 can rotate around the horizontal rotating shaft 3100. As shown in FIG. 2, the casing 31 other than the cutter 61, the auxiliary feeding path 81, and the feeding roller 71, and is drawn out by being rotated substantially 90 degrees. Thus, as compared with the related apparatus from which the casing 31 including the cutter 61, the auxiliary feeding path 81, and the feeding roller 71 is horizontally drawn out, a space required to open and close the casing 31 can be reduced.

Figure 4:
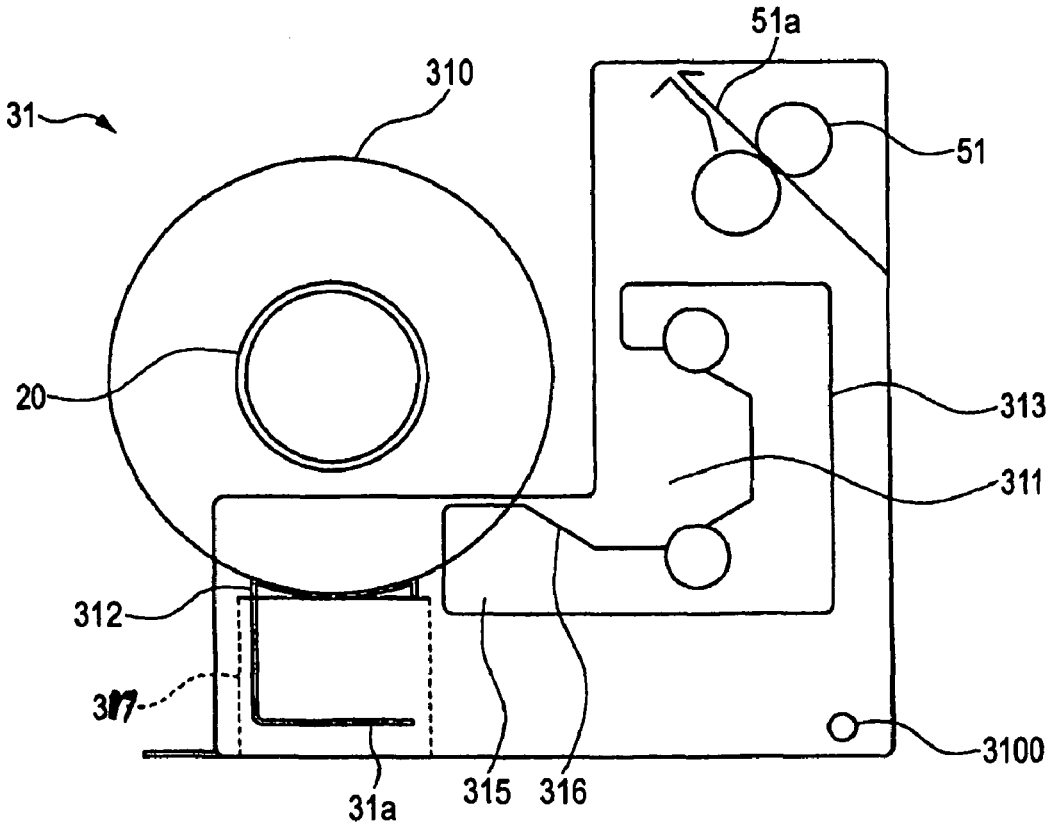
FIG. 4 is an enlarged cross-sectional view illustrating a state in which the casing of the paper supply unit is drawn out.

FIG. 4 is a view illustrating a state in which the paper roll 310 is tentatively put on the roll paper holding portion 312 placed at a leftwardly lower portion (at the side closest to a user) of the casing 31 when the casing 31 is drawn out by being rotated substantially 90 degrees.

As shown in FIG. 4, in a state in which the casing 31 is drawn out by being rotated substantially 90 degrees, the aforementioned roll paper holding portion 312 is placed at the leftwardly lower portion of the casing 31. The roll paper holding portion 312 has a concave shape, on which the paper roll 310 can tentatively be put. The size of the concave shape is slightly larger than the curvature radius of the outside diameter of the paper roll 310. Therefore, the paper roll 310 is put on the roll paper holding portion 312 in a stable state due to the own weight thereof.

As shown in FIG. 4, each of the shaft holding members 313 constituting the roll paper accommodating portion 311 has a rail portion 315 that acts as a guiding section and is horizontally projecting toward the vicinity of the roll paper holding portion 312. When the casing 31 is drawn out by being rotated substantially 90 degrees, the rail portion 315 is placed in a horizontal direction with respect to the roll paper holding portion 312. An incline 316 is provided to have a rising gradient that increases toward the roller paper holding portion 312. As shown in FIG. 4, when the casing 31 is drawn out by being rotated substantially 90 degrees, the delivery rollers 51 and the feeding path 51a are placed on an upper portion of the casing 31.

Figure 5:
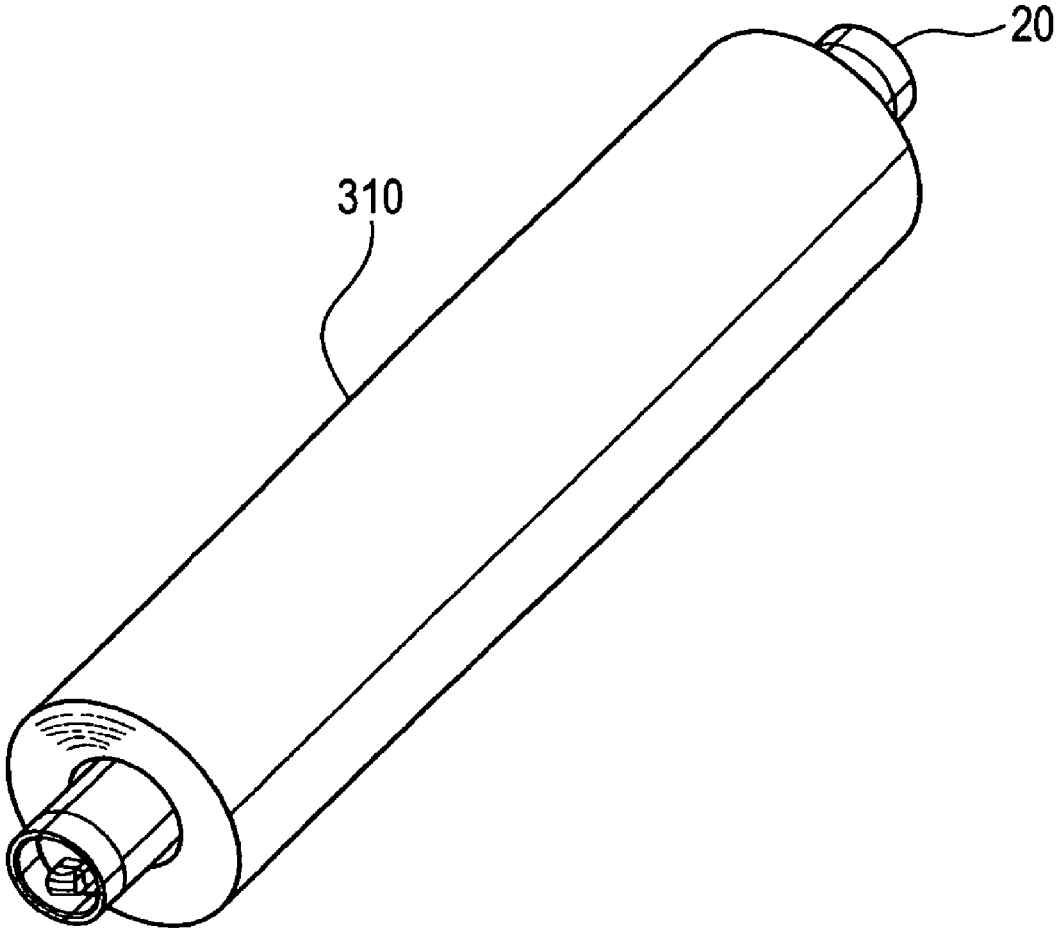
FIG. 5 is a view illustrating a state in which a shaft is mounted in a paper roll.

FIG. 5 is a view illustrating a state in which the shaft 20 is mounted in the paper roll. A user mounts the shaft 20 therein in a state in which the paper roll is put on the roll paper holding member. Incidentally, the shaft 20 is cylindrically shaped and has both ends, at which gears (not shown) are provided. The paper supply unit 3 can rotate the shaft through the gears.

The image forming apparatus 1 according to the invention has the aforementioned configuration. When the paper roll 310 is replaced, the image forming apparatus 1 operates as follows. That is, first, a user draws the drawing lever 31*a* provided in the concave portion 317 at the upper portion of the left side surface of the casing 31 shown in FIG. 1 thereby to rotate the casing 31 around the horizontal rotating shaft 3100 substantially 90 degrees and to draw out the casing 31. It is considered that at that time, the roll paper 310 spontaneously performs rotational displacement. However, the incline 316 provided on the rail portion 315 of the shaft holding member 313 suppresses this rotational displacement, so that the paper roll 310 is stable held in the roll paper accommodating portion 311.

Upon completion of drawing out the casing 31, the user causes the shaft 20 to perform rotational displacement on the rail portion 315. Thus, the paper roll 312 to the roll paper holding portion 312. At that time, the rail portion 315 and the roll paper holding portion 312 come very close to each other and are arranged in a substantially horizontal line. Thus, it is sufficient for the user to cause the paper roll 310 to perform rotational and horizontal displacement from the rail portion 315 to the roll paper holding portion 312. When the paper roll 310 is put on the roll paper holding portion 312, the user removes the shaft 20 from the paper roll 310. Thus, a procedure for removing the paper roll 310 is completed.

Next, a procedure for accommodating the paper roll 310 is described below. In the state in which the casing 31 is drawn out by being rotated substantially 90 degrees, the user puts a newly used paper roll 310 on the roll paper holding portion 312. Subsequently, the user mounts the shaft 20 in the paper roll 310. Because the paper roll 310 is put on the roll paper holding portion 312, the user can mount the shaft 20 therein in a stable condition.

Upon completion of mounting the shaft 20, the user rolls the paper roll 310 toward the roll paper accommodating portion 311 to first put both ends of the shaft 20 on the rail portion 315. Incidentally, because the rail portion 315 and the roll paper holding portion 312 are very close to each other and are arranged in a substantially horizontal line, it is sufficient for the user to cause the paper roll 310 to perform rotational and horizontal displacement to the rail portion 315 from the roll paper holding portion 312. The shaft 20 put on the rail portion 315 automatically performs rotational displacement to the roll paper accommodating portion 311 due to the incline 316, which has a falling gradient, on the rail portion 315. Thus, the paper roll 310 is accommodated on the roll paper accommodating portion 311.

After the paper roll 310 is accommodated, the user draws an edge part of paper out of the paper roll 310 and puts the edge part between the delivery rollers 51. At that time, the delivery rollers 51 are placed higher than the paper roll 310 accommodated on the roll paper accommodating portion 311. Thus, an operation of putting the edge part of the roll paper 310 between the delivery rollers 51 can be performed in a state in which visual check is easily achieved.

Upon completion of the operation up to this stage, the user pushes the casing 31 into the paper supply unit 3 by rotating the casing 312 substantially 90 degrees. Thus, the change of the roll paper 310 is completed. Regarding the casing 32, the change of the roll paper 320 can be performed by performing an operation similar to that performed on the casing 31.

Thus, according to the invention, the reduction of space required by the paper supply unit can be achieved. Also, a work burden, which is caused by accommodating the roll paper and is imposed on a user, can be reduced. The risk of fall of the paper roll can be reduced. Additionally, the reduction of the cost can be achieved.

The entire disclosure of Japanese Patent Application No. 2005-272954 including specification, claims, drawings, and abstract is incorporated herein by reference in its entirely.

What is claimed is:

1. An image forming apparatus comprising:

at least one rotatable paper supply portion including:

a roll paper accommodating portion that supports a paper roll constituted by winding long paper around a shaft in an operating position in which the paper supply portion is not drawn out;

a roll paper holding portion on which the paper roll is temporarily put;

a paper feeding portion that delivers paper from the paper roll accommodated on the roll paper accommodating portion; and a horizontal rotating-shaft that rotatably supports the paper supply portion in a body of the image forming apparatus, the paper supply portion drawn outwardly from the body of the image forming apparatus by being rotated when change of the paper roll is performed, wherein the change of the paper roll can be performed by rotating the paper supply portion to thereby draw out the paper supply portion, wherein the roll paper is temporarily put on the roll paper holding portion when the paper supply portion is drawn out from the body, wherein the horizontal rotating-shaft is on a drawing side of the paper supply portion drawn from the image forming apparatus, and the horizontal rotating-shaft is disposed in a lower portion of the paper supply portion;

the roll paper accommodating portion includes:

a holding section that holds the shaft to be rotatable when operated:

a guiding section configured to support ends of the shaft arranged together with the roll paper holding portion in a substantially horizontal line when the paper supply portion is rotated and is drawn out to lead the paper roll to the roll paper accommodating portion; and a suppressing section that suppresses the paper roll from spontaneously performing rotational displacement when the paper supply portion is rotated and is drawn out.

2. The image forming apparatus according to claim 1, wherein the suppressing section includes an incline provided to have a gradient increasing toward the roll paper holding portion from the roll paper accommodating portion when the paper supply portion is rotated and is drawn out.

3. The image forming apparatus according to claim 1, wherein the paper feeding portion is placed in vicinity of an upper part of the paper supply portion when the paper supply portion is rotated and is drawn out.

4. The image forming apparatus according to claim 1, the roll paper holding portion has a handle part used to rotate and draw out the paper supply portion.

5. The image forming apparatus according to claim 1, wherein the accommodating portion further includes a holding section that holds the shaft to be rotatable when operated; and the roll paper holding portion on which the paper roll is temporarily put is disposed substantially horizontal to the holding section.

6. An image forming apparatus comprising:

at least one rotatable paper supply portion including:

a roll paper accommodating portion that supports a paper roll constituted by winding long paper around a shaft in an operating position in which the paper supply portion is not drawn out;

a roll paper holding portion on which the paper roll is temporarily put;

a paper feeding portion that delivers paper from the paper roll accommodated on the roll paper accommodating portion; and a horizontal rotating-shaft that rotatably supports the paper supply portion in a body of the image forming apparatus, the paper supply portion drawn outwardly from the body of the image forming apparatus by being rotated when change of the paper roll is performed, wherein the change of the paper roll can be performed by rotating the paper supply portion to thereby draw out the paper supply portion, wherein the roll paper is temporarily put on the roll paper holding portion when the paper supply portion is drawn out from the body, wherein the horizontal rotating-shaft is on a drawing side of the paper supply portion drawn from the image forming apparatus, and the horizontal rotating-shaft is disposed in a lower portion of the paper supply portion;

wherein the roll paper accommodating portion includes:

a holding section that holds the shaft to be rotatable when operated; and a guiding section configured to support ends of the shaft arranged together with the roll paper holding portion in a substantially horizontal line when the paper supply portion is rotated and is drawn out to lead the paper roll to the roll paper accommodating portion.

7. The image forming apparatus according to claim 1, wherein the holding section is above the guiding section when the paper supply portion is in the operating position.

8. The image forming apparatus according to claim 6, wherein the holding section is above the guiding section when the paper supply portion is in the operating position.

9. The image forming apparatus according to claim 1, wherein the holding section comprises balls or rollers.

10. The image forming apparatus according to claim 6, wherein the holding section comprises balls or rollers.

11. The image forming apparatus according to claim 1, wherein the change of the paper roll can be performed by rotating the paper supply portion substantially 90 degrees to thereby draw out the paper supply portion.

12. The image forming apparatus according to claim 1, wherein the rotatable paper supply portion is substantially L-shaped.

13. The image forming apparatus according to claim 1, wherein the roll paper is temporarily put on the roll paper holding portion when substantially the entire the paper supply portion is drawn out.

14. The image forming apparatus according to claim 11, wherein the roll paper is temporarily put on the roll paper holding portion when substantially the entire the paper supply portion is drawn out.

15. The image forming apparatus according to claim 14, wherein the change of the paper roll can be performed by rotating the paper supply portion substantially 90 degrees to thereby draw out the paper supply portion.

16. The image forming apparatus according to claim 6, wherein the rotatable paper supply portion is substantially L-shaped.

* * * * *